United States Patent [19]

Yamaguchi et al.

[11] Patent Number: 4,860,802

[45] Date of Patent: Aug. 29, 1989

[54] FILLING LIQUIDS

[75] Inventors: Shogo Yamaguchi; Kazunori Araki; Hisashi Tazuke, all of Nagoya, Japan

[73] Assignee: Mitsubishi Jukogyo Kabushiki Kaisha, Tokyo, Japan

[21] Appl. No.: 96,405

[22] Filed: Sep. 15, 1987

[51] Int. Cl.[4] ..... B65B 3/04

[52] U.S. Cl. ..... 141/6; 141/40; 141/103

[58] Field of Search ..... 141/1-9, 141/39, 40, 104, 103, 100

[56] References Cited

U.S. PATENT DOCUMENTS

| | | | |
|---|---|---|---|
| 2,700,495 | 1/1955 | Jacobs | 141/103 |
| 2,743,047 | 4/1956 | Clarke | 141/6 |
| 2,825,190 | 3/1958 | Heald | 141/11 |
| 2,880,912 | 4/1959 | Fisher | 141/104 X |
| 2,988,450 | 6/1961 | Bulatkin | 426/399 |
| 3,212,537 | 10/1965 | Hinxlage et al. | 141/6 |
| 3,552,453 | 1/1971 | Ball et al. | 141/7 |
| 3,834,430 | 9/1974 | Fechheimer | 141/119 |
| 3,871,425 | 3/1975 | Fee et al. | 141/5 |
| 4,146,065 | 3/1979 | Borstelmann | 141/5 |
| 4,487,237 | 12/1984 | Sick et al. | 141/39 |

*Primary Examiner*—Ernest G. Cusick

*Attorney, Agent, or Firm*—Wenderoth, Lind & Ponack

[57] ABSTRACT

A method for filling liquids includes first supplying container with a gas-generating water or water in an amount somewhat greater than a predetermined amount thereof and subsequently filling the container with a predetermined amount of an undiluted solution by injection thereof, after which the excess portion of the gas-generating water or water is removed from an upper stratum or portion of liquid in the container. Thereby, the amounts of the two liquids filled into the container correspond to the predetermined amounts. By first supplying the container with the gas-generating water or water and subsequently filling the container with the undiluted solution, the gas-generating water or water is unsusceptible to mixing with the undiluted solution. The final filled quantity of the liquid product is controlled by removing excess quantity of the first supplied gas-generating water or water, whereby the accuracy of the contents and amounts of liquids filled is improved.

4 Claims, 1 Drawing Sheet

FILLING LIQUIDS

BACKGROUND OF THE INVENTION

1. Field of the Invention

The present invention relates to a method of filling liquids into containers and particularly is applicable to equipment for filling bottles, cans and the like with liquids, particularly in the food industry.

2. Description of the Prior Art

A conventional method for filling containers such as bottles, cans and the like involves first supplying a constant volume or a constant weight of an undiluted solution (syrup or the like) and subsequently filling the particular container with gas-generating water (carbonated water) or water, as occasion requires, up to a constant liquid level.

This conventional method, wherein the bottles or cans or the like first are supplied with the undiluted liquid and then are filled with the gas-generated water or water, suffers from the problems itemized below.

(1) The undiluted solution (syrup or the like) is mixed with the gas-generating water or water during the course of filling of the water. In the case of a carbonated drink, foaming is apt to be caused, leading to susceptibility of the concentration of the liquid product being changed after filling.

(2) If liquid falls or spills from the bottles, cans, or the like during transportation thereof prior to the operation of closure by the use of crowns or caps, this also leads to susceptibility of the concentration of the liquid product being changed after filling.

(3) It is difficult to fill the gas-generating water or water in a manner to maintain the predetermined liquid level, and this results in causing susceptibility to unevenness in the density of the liquid product filled into containers such as bottles or cans or the like.

SUMMARY OF THE INVENTION

It is an object of the present invention to solve the above and other problems of the foregoing prior art method by providing a method of supplying containers firstly with the gas-generating water or water and subsequently filling the containers with the undiluted solution (syrup or the like).

It is another object of the present invention to provide a method of filling the undiluted solution either by immersing the lower end of an undiluted solution injection nozzle or by not immersing the lower end of such nozzle so that the gas-generating water or water, which was supplied previously, will not easily be mixed with the diluted solution filled subsequently.

It is a further object of the present invention to provide a method of removing excess gas-generating water or water by means of suction or pressure such that the final content of the liquid product in the bottle, can or the like will be at a predetermined liquid level or a predetermined filling weight.

In order to achieve the foregoing objects, the present invention provides a method for filling predetermined amounts of such liquids into a container wherein the container first is supplied with the gas-generating water or water in an amount somewhat larger than the predetermined amount thereof and subsequently is filled with the predetermined amount of the undiluted solution to complete the filling operation, after which the excess portion of the gas-generating water or water is removed from the upper stratum of the liquid within the container, whereby the amount of liquid filled into the container equals the predetermined amounts.

The advantages of the present invention will be more fully understood from the following description of the preferred embodiments, with reference to the accompanying drawings.

BRIEF DESCRIPTION OF THE DRAWINGS

FIG. 3(*b*) is a schematic illustration showing the state in which the undiluted solution injecting nozzle pipe is separated from the gas-generating water.

DETAILED DESCRIPTION OF THE PREFERRED EMBODIMENTS

Figure 1A:
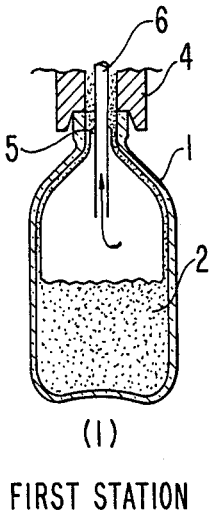
FIGS. 1(*a*) and 1(*b*) are schematic views illustrating the steps of a method for filling liquids according to the present invention.
Figure 1B:
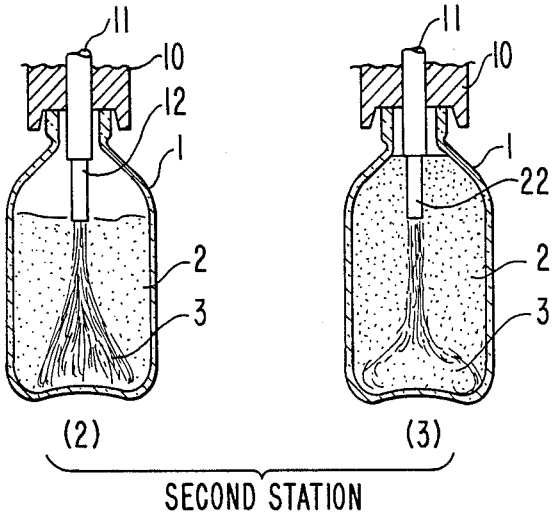

FIGS. 1(*a*) and 1(*b*) illustrates the steps of a method for filling liquids according to the present invention. This is an example of filling a container 1 with two types of liquid including gas-generating water or water 2 and an undiluted solution 3. The container 1 is a filling container such as a bottle, can or the like, and a bottle is shown in this example. The gas-generating water or water 2 is a gas-generating water (carbonated water) in which a predetermined amount of carbonic acid gas is dissolved at a predetermined temperature in the case of filling the bottles with a carbonated cooling drink, while the water 2 is water at normal temperatures or water heated at a predetermined temperature in the case of filling the bottles with a non-carbonic acid drink, for example, a drink containing fruit juice or the like.

The undiluted solution 3 is a solution or syrup containing a sweetening agent, souring agent, spices, fruit juice and the like, which has been cooled or heated to a predetermined temperature dependent upon the particular ingredients, in the case of filling the bottles with a cooling drink.

FIG. 1(*a*) step (1) (the first station) shows an example of a state in which the container 1 is being filled with the gas-generating water or water 2. Reference numeral 4 denotes a seal member, reference numeral 5 denotes a spreader, and reference numeral 6 denotes a vent pipe. A particular pressure, dependent on the operation, is achieved in container 1 preliminarily with a counter gas by a mechanism not shown. The gas-generating water or water 2 is supplied to the container 1 by a device not shown. The spreader 5 serves to cause the supplied gas-generating water or water 2 spread along the inner wall surfaces of the container 1, so that the amount of counter gas caught up or dissolved in the water 2 is minimized. The vent pipe 6 serves to return the counter gas from the container 1 into a tank or the like now shown, whereby the filling of the gas-generating water or water stops when the filling liquid level reaches the lower end of the vent pipe 6. The container 1 is filled with the gas-generating water or water 2 by an amount at least somewhat larger than the amount required, but the precise amount of this filling is not required to be highly accurate.

FIG. 1(*b*) step (2) (the second station) shows a state in which the container 1 is being supplied with the undiluted solution (syrup or the like) 3 after having been supplied with the gas-generating water or water 2 at the first station as described above. Reference numeral 10 denotes a seal member, while reference numeral 11 denotes an undiluted solution injection pipe assembly. The container 1 is sealed hermetically by the seal member 10 as necessary, and pressure in container 1 is achieved preliminarily by a counter gas by the mechanism not shown, as necessary, before filling the container 1 with the undiluted solution 3. The undiluted solution injection pipe assembly 11 is used to supply a predetermined amount of undiluted solution (syrup or the like) 3 under pressure into the gas-generating water or water 2, with which the container 1 was supplied during the preceding step, by a mechanism not shown, for example, a piston type measuring mechanism or the like. Preferably, the lower end of the undiluted solution injection pipe assembly 11 is immersed below the gas-generating water or water 2 as shown, and it is important to prevent the counter gas from being dissolved into the gas-generating water or water 2 at least when the undiluted solution 3 is being injected into the gas-generating water or water 2.

FIG. 1(*b*) step (3) (the second station) shows a state in which the container 1 has been supplied with a predetermined amount of undiluted solution (syrup or the like) in the second step, after having been supplied with the gas-generating water or water 2 in the first step, Because the undiluted solution (syrup or the like) is injected from the lower end of the undiluted solution injection pipe into the gas-generating water or water 2, the upper stratum section of liquids with which the container 1 is filled consists almost exclusively of the gas-generating water or water 2, while the undiluted solution 3 is existent in the middle stratum section and the lower stratum section.

Figure 2:
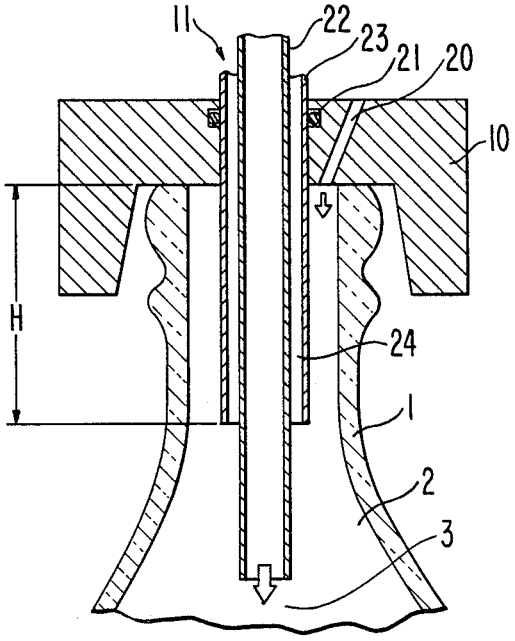
FIG. 2 is an enlarged view of the upper section of the arrangement shown at (3) in FIG. 1(*b*)

FIG. 2 is an enlarged view of FIG. 1(*b*) step (3) and shows the state in which a predetermined amount of undiluted solution (syrup or the like) 3 has been injected into the container 1 after having been supplied with the gas-generating water or water 2 in the first step. Reference numeral 10 denotes the seal member, reference numeral 20 denotes a passage for counter gas, reference numeral 21 denotes an O-ring, reference numeral 23 denotes a vent pipe or assembly 11, and reference numeral 22 denotes an undiluted solution (syrup) injection nozzle pipe of assembly 11. The passage 20 is used to feed under pressure counter gas into the container 1 by a mechanism not shown for achieving preliminarily in the container 1 a pressure, with counter gas such as clean air, $N_2$ gas or carbonic acid gas, as the particular operation requires, and in particular in the case of producing a carbonic acid cooling drink, a pressure for preventing the occurrence of foaming (the phenomenon of foaming carbonic acid gas under the condition of supersaturation) during the filling operation.

The vent pipe 23 is used, during the injection of the undiluted solution (syrup or the like), to return the counter gas from the container 1 into a tank or the like. The depth of the lower end of pipe 23, which is shown as H in FIG. 2, can be adjusted by a mechanism not shown to regulate the amount of liquids with which one wants to fill the container 1. The O-ring 21 serves to seal the seal section 10 and the vent pipe 23. The undiluted solution injection nozzle pipe 22 has a passage for injecting a predetermined amount of undiluted solution into the container 1 by the mechanism now shown, for example the piston type measuring mechanism, and can be made to move up or down by the mechanism not shown during the filling operation.

The end of the undiluted solution injectioon nozzle pipe 22 may be provided with a valve seal for the purpose of preventing after-drip of the undiluted solution after completion of filling operation, depending on the viscosity and the like of the undiluted solution to be filled.

With the completion of the filling of the undiluted solution (syrup or the like) 3, the total amount of liquid supplied is greater than the amount required, because a somewhat greater amount of the gas-generating water or water 2 was filled during the first step. Two methods described below can be employed for achieving a predetermined total amount of liquid within the container, with little variation, at the time of completion of filling.

(Method A): At the time of completion of filling, either counter gas is fed under pressure through the counter gas passage 20 or a vent passage 24 within pipe 23 is released to the atmospheric pressure by the mechanism not shown. The pressure of the counter gas or a pressure achieved preliminarily causes the excess quantity of the gas-generating water or water 2 to be discharged through the vent passage 24, so that the total amount of filled liquid in the container can be controlled to be a predetermined amount.

(Method B): At the time of completion of filling, the vent passage 24 is connected to a suction mechanism not shown and the excess quantity of gas-generating water or water 2 is drawn by suction through the vent passage 24, whereby the total amount of filled liquid in the container can be controlled to be the predetermined amount. (At this time, it is more effective to supply a necessary amount of counter gas through passage 20 as occasion requires.)

FIG. 2 shows an example of a double pipe construction of the undiluted solution injection nozzle pipe 22 and the vent pipe 23. The action of such a double construction pipe, however, is the same as if the undiluted solution injection nozzle pipe 22 and the vent pipe 23 were to be of individual and independent construction. Further, the total amount of filled liquid can be regulated in two ways. Firstly, such amount can be regulated by fixing the vent pipe 23 at the predetermined liquid level position. Secondly, the weight of liquid to be filled is determined, and the total filled amount can be regulated by controlling the level or position of the vent pipe so that the filled amount will be the predetermined amount.

Description now will be made of the relationships between the end position of the undiluted solution injection nozzle pipe 22 and the surface of the liquid.

Figure 3A:
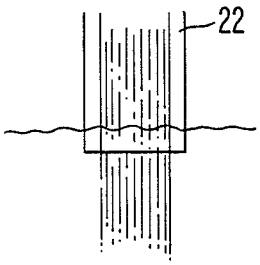
FIG. 3(*a*) is a schematic illustration showing the state in which an undiluted solution injecting nozzle pipe is immersed in gas-generating water.
Figure 3B:
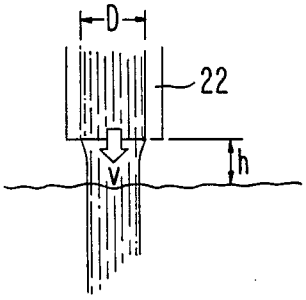

FIG. 3(*a*) shows the case where the end of the undiluted solution injection nozzle is immersed in the gas-generating water at the beginning of supply of the undiluted solution. In this case, head space gas (air) is not dissolved in the undiluted solution.

FIG. 3(*b*) shows the case where the end oft he undiluted solution injection nozzle is not immersed in the gas-generating water at the beginning of supply of the undiluted solution. In this case, the head space gas (air) will not be dissolved in the undiluted solution (syrup) by setting the nozzle diameter D, the height from the surface of liquid h and the flow rate v for injection of the undiluted solution to suitable values. In other words, it is possible to perform syrup filling, with no or little head space gas being dissolved in the syrup.

It may be preferable for the end of the undiluted solution injection nozzle pipe to be separated from the surface of liquid, because the end of the nozzle pipe then does not make contact with the gas-generating water or water.

Accordingly, when the undiluted solution is injected into the gas-generating water or water, the undiluted solution injection nozzle pipe 22 may or may not be immersed in the gas-generating water or water 2.

From the description referred to above, the present invention provides the following features:

(1) Firstly, the container first is filled with the gas-generating water or water into which the undiluted solution then is injected, and therefore no gas is dissolved in the undiluted solution and the upper stratum section of the container will be filled only with gas-generating water or water.

(2) When the injection of the undiluted solution into an excess amount of gas-generating water or water already filled in advance is completed, the upper stratum section of the container will contain only or substantially only the gas-generating water or water. Therefore, a highly accurate filling operation is achieved by removing only the excess amount of gas-generating water or water by pressurization or suction.

(3) At the time of being exposed to the air after completion of the filling operation, even if the liquid overflows by foaming or similar phenomenon, the liquid overflow is the gas-generating water or water. Therefore, there is no loss of ingredients of the undiluted product from the container, and the concentration of liquid product remains substantially constant.

The foregoing preferred embodiments are considered illustrative only. Numerous other modifications and changes will readily occur to those persons skilled in the art from the present disclosure. Consequently, the disclosed invention is not limited to the exact features shown and described above, and the scope of the invention is to be determined from the appended claims.

What is claimed is:

1. A method for filling a container with predetermined amounts of a gas-generating water or water and of an undiluted solution to thereby provide a filled liquid product, said method comprising:

first supplying into said container an amount of said gas-generating water or water greater than said predetermined amount thereof;

subsequently filling into said container said predetermined amount of said undiluted solution such that the upper stratum of liquid product filled into said container comprises substantially entirely said gas-generating water or water unmixed with said undiluted solution; and removing from said upper stratum and from said container the amount of said gas-generating water or water in excess of said predetermined amount thereof;

whereby said filled liquid product within said container includes said predetermined amounts of said gas-generating water or water and of said undiluted solution.

2. A method as claimed in claim 1, wherein said filling of said undiluted solution into said container comprises immersing an end of an undiluted solution injection nozzle in said gas-generating water or water in said container, and then injecting said predetermined amount of said undiluted solution through said nozzle.

3. A method as claimed in claim 1, wherein said filling of said undiluted solution into said container comprises positioning an end of an undiluted solution injection nozzle at a level above said gas-generating water or water in said container, and then injecting said predetermined amount of said undiluted solution through said nozzle.

4. A method as claimed in claim 1, comprising conducting said filling of said undiluted solution into said container under substantially atmospheric pressure.

* * * * *